United States Patent [19]

Vigna

[11] 4,232,795

[45] Nov. 11, 1980

[54] NON-REFILLABLE BOTTLE CLOSURE

[75] Inventor: Nicola Vigna, Montecarlo, Monaco

[73] Assignee: Tradall S.A., Geneva, Switzerland

[21] Appl. No.: 50,254

[22] Filed: Jun. 20, 1979

[30] Foreign Application Priority Data

Jul. 4, 1978 [CH] Switzerland ..... 7294/78

[51] Int. Cl.[3] ..... B65D 49/02

[52] U.S. Cl. ..... 215/21; 215/252

[58] Field of Search ..... 215/21, 26, 28, 29

[56] References Cited

U.S. PATENT DOCUMENTS

| | | | |
|---|---|---|---|
| 3,084,822 | 4/1963 | Guala | 215/21 |
| 3,810,558 | 5/1974 | Crisp | 215/21 |

*Primary Examiner*—Donald F. Norton

*Attorney, Agent, or Firm*—Sughrue, Rothwell, Mion, Zinn & Macpeak

[57] ABSTRACT

A bottle closure device comprising a valve body provided with a seat co-operating with an inverted mushroom headed valve shutter. An externally threaded cap support is rigidly secured to the valve body to receive an internally threaded cap provided with an axial pin having longitudinal ribs able to engage into an axial cavity in the stem of the shutter in such a way as to engage therein to cause the rotation of the shutter with respect to its seat upon unscrewing of the cap. For the purpose of ensuring engagement between the pin and the valve shutter the ribs have sharp outer edges and are of such a size and shape that they engage with interference against the walls of the axial cavity, which has a circular cross section, when the cap is fully screwed on to the cap support.

5 Claims, 5 Drawing Figures

NON-REFILLABLE BOTTLE CLOSURE

The present invention relates to a bottle closure device of the type having means for preventing tampering with the contents of the bottle once it is closed, and particularly to a bottle closure device of the type incorporating a valve for regulating the flow of liquid upon being poured from the bottle.

Known devices of this general type are capable of providing a regular and abundant flow of liquid contained in the bottle upon pouring out, and also provide a guarantee against the fraudulent introduction of liquids into the bottle itself.

In particular the present invention relates to a bottle closure of the type including a valve body intended to be inserted as a plug into the neck of a bottle and provided at one end with an annular flange intended to abut against the end face of the neck of the bottle; an annular valve seat within the valve body, an inverted mushroom headed valve shutter having a hollow tubular stem the axial cavity of which is open at the free end thereof and an enlarged head for cooperation with the said valve seat, a cap support fixed at one end to the said valve body and having an externally threaded cylindrical portion for receiving a correspondingly threaded cap having an axially extending central pin provided with longitudinal ribs, which pin enters the axial cavity of the stem of the valve shutter when the cap is screwed onto the said cap support.

The length of the pin within the cap is chosen in such a way as to cause the mushroom head of the valve shutter to approach closely against the associated annular valve seat when the cap is screwed completely onto the cap support element, so that perfect closure of the bottle against the fraudulent introduction of liquid into the bottle through the closure device is ensured. The bottle is at the same time sealed against the leakage of liquid.

When bottles provided with known such closure devices are subjected, whilst the bottle is closed, to changes in the ambient conditions, in particular to a drop of temperature (occurring for example, when the bottle is put in a refrigerator) there is a consequent decrease of pressure within the bottle, and in some cases the mushroom head of the valve shutter can be pressed so strongly against the associated valve seat by the pressure difference between the interior of the bottle and the surrounding atmosphere that it prevents the flow of liquid from the bottle when the cap is removed.

In the known closure device, in an attempt to avoid this disadvantage, the pin projecting from the bottom of the cap is formed with longitudinal ribs so that its profile in cross section is not circular, and the cavity formed in the stem of the valve shutter is provided with a correspondingly shaped cross section. In a particular example the pin carried by the cap is formed with two pairs of diametrically opposed ribs in such a way that the pin has a substantially cruciform cross section, and the axial cavity formed in the stem of the valve shutter has a corresponding cruciform shape.

This arrangement is intended to facilitate the separation of the valve shutter from the associated valve seat upon rotation of the cap; however it does not work to provide total release of the valve shutter if there is a decrease of pressure within the interior of the bottle since the ribs simply slide axially within the correspondingly shaped cavity in the valve stem.

According to the present invention, there is provided a bottle closure device, for sealably closing and preventing fraudulent filling of bottles fitted therewith, including a valve body intended to be inserted as a plug into the neck of a bottle and provided at one end with an annular flange intended to abut against the end face of the neck of the bottle, an annular valve seat within the valve body, an inverted mushroom headed valve shutter having a hollow tubular stem the axial cavity of which is open at the free end thereof and an enlarged head for co-operation with the said valve seat, a cap support fixed at one end to the said valve body and having an externally threaded cylindrical portion for receiving a correspondingly threaded cap having an axially extending central pin provided with longitudinal ribs, which pin enters the axial cavity of the stem of the valve shutter when the cap is screwed onto the said cap support, in which the said longitudinal ribs each have a sharp outer edge, and the said axial cavity of the stem of the valve shutter has, at least at the end thereof nearest the mushroom head of the valve shutter, a circular cross section, the said ribs on the pin of the cap being so formed that, when the cap is completely screwed onto the cap support, the radial distance between the said sharp outer edges thereof and the axis of the pin of the cap, at any point along the axis of the pin, is greater than the radius of the said circular section part of the axial cavity in the stem of the valve shutter at that point.

With such an arrangement there is friction between the pin of the cap and the interior of the stem of the shutter, so that upon unscrewing the cap the shutter not only turns with the pin, but is also displaced axially to be separated from the valve seat, thus making it possible to pour the liquid from the bottle without delay. This advantage is obtained, moreover, without requiring changes to the structure which would necessitate giving up the completely automatic assembly of the closure device which is a particular advantage of bottle closure devices of this type.

One embodiment of the present invention will now be more particularly described, by way of example, with reference to the accompanying drawings, in which.

Figure 1:
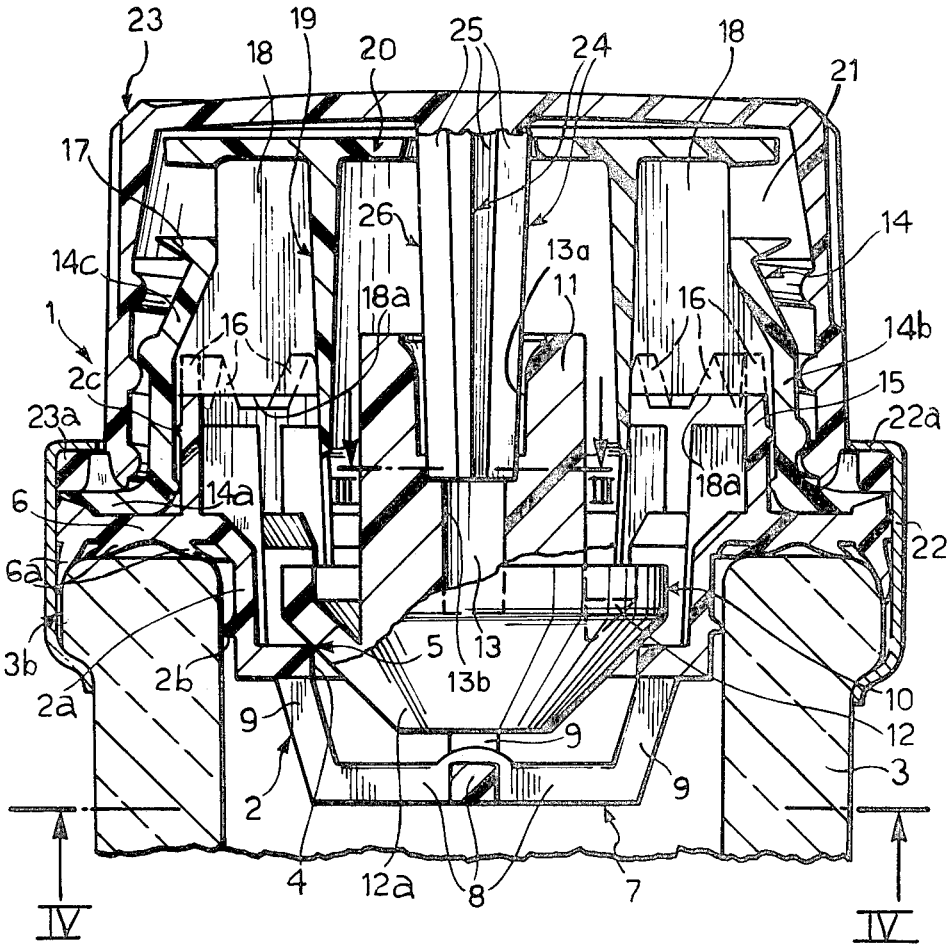
FIG. 1 is a longitudinal side view, partially sectioned, of a device according to the invention applied to the neck of a bottle and shown in a completely closed condition.
Figure 2:
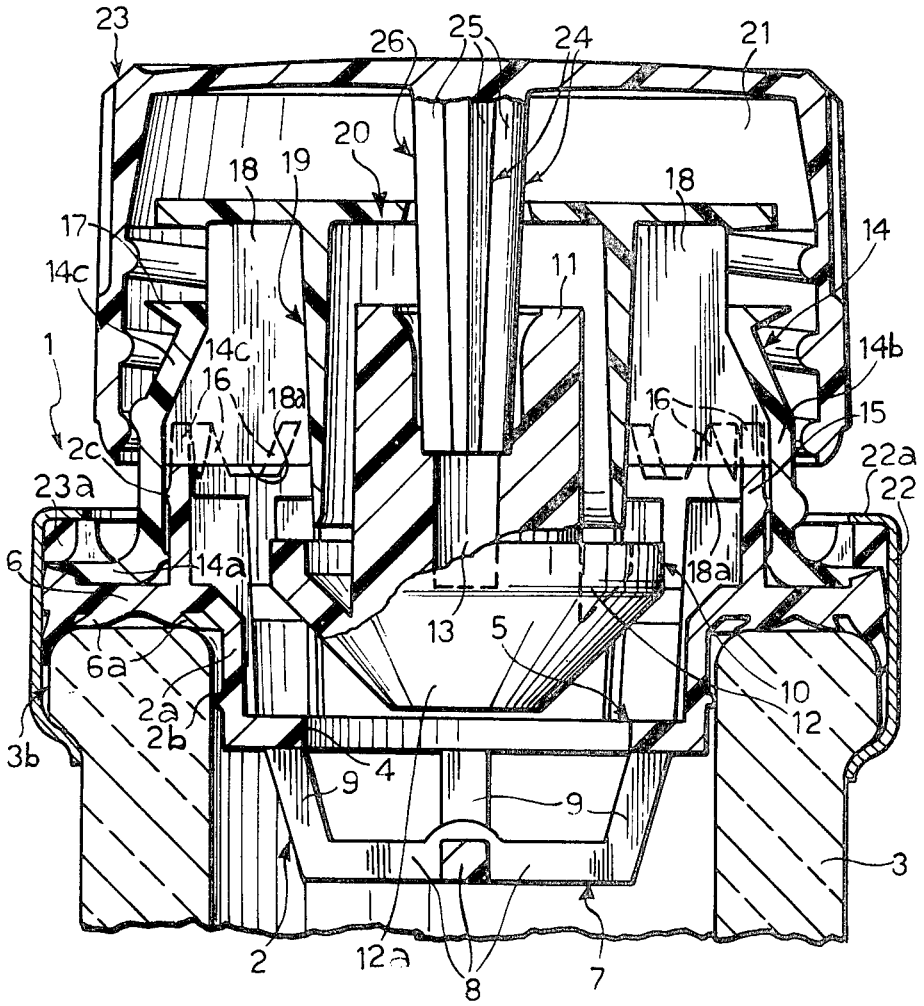
FIG. 2 is a longitudinal side view, partially sectioned, of the device illustrated in FIG. 1, shown with the cap partially unscrewed.

Referring now to the drawings, there is shown a bottle closure device, generally indicated 1, comprising a valve body 2 inserted in the manner of a plug into a neck 3 of a bottle. The valve body 2 has a central hole 4 the upper edge of which constitutes an annular valve seat 5. The valve body 2 includes a cylindrical portion 2*a* which in use is forced into the interior of the neck 3 of the bottle, and at one end of the cylindrical portion 2*a*, an annular flange 6 which abuts the end face of the neck 3 of the bottle.

Figure 5:
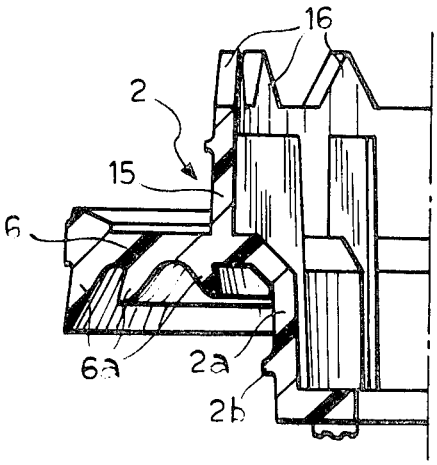
FIG. 5 is a longitudinal section, on an enlarged scale, of one of the elements of the device illustrated in FIGS. 1 and 2.

The face of the annular flange 6 intended to contact the end face of the neck 3 of the bottle has three concentric circumferential sealing lips 6a, extending in a direction substantially perpendicular to the flange 6 (see FIG. 5). When the valve body 2 is inserted into the neck 3 of a bottle the sealing lips 6a deform, assuming the configuration illustrated in FIG. 1. It will be noted that the radially outermost sealing lip has a greater height than the other two sealing lips, and is shaped in such a way as to be able to engage against the radially outer corner between the end face of the neck 3 of the bottle and the outer surface 3b of the neck 3 of the bottle.

The cylindrical portion 2a of the valve body 2 is also provided with a circumferential sealing lip 2b co-operating with the inside face of the neck 3 of the bottle to ensure, together with the sealing lips 6a that no leakage of liquid contained in the bottle can take place through the region lying between the inside face of the neck 3 of the bottle and the outer surface of the cylindrical portion 2a of the valve body 2.

The valve body 2 is provided at its end opposite the annular flange 6 with a cage structure 7 constituted by four radial arms 8 disposed in the form of a cross and joined to the remaining part of the valve body 2 by means of arms 9 which diverge slightly towards the hole 4.

An inverted, mushroom headed, valve shutter 10 having a tubular stem 11 and a mushroom head 12 with a frusto-conical surface 12a is positioned to co-operate with the annular valve seat 5 in the valve body 2. The stem 11 of the mushroom headed valve shutter 10 has an axial cavity 13 open at the free end of the stem 11. The axial cavity 13 has a mouth part 13a adjacent the free end of the stem 11 and an inner part 13b of cylindrical form adjacent the mushroom head 12. The cross section of the inner part 13b could also reduce progressively towards the mushroom head. The valve shutter 10 is trapped loosely between the valve body 2 and a cap support 14, which latter is provided at one of its ends with an annular flange 14a abutting the annular flange 6 of the valve body 2. The cap support 14 and the valve body 2 are connected together by means of a cylindrical portion 15 of the valve body 2, located adjacent the flange 6, and on the side thereof facing towards the cap support element 14, which cylindrical portion 15 is forced into the interior of a co-operating cylindrical portion 14b of the cap support element 14. The cylindrical portion 15 of the valve body 2 is formed with a circumferential sealing lip 2c, for sealing the space between the two interengaged cylindrical portions. The free end of the cylindrical portion 15 of the valve body 2 has a plurality of teeth 16.

The cylindrical portion 14b of the cap support element is externally threaded for receiving a cap screwed onto the cap support element, and at the end opposite the annular flange 14a has a frusto-conical portion 14c terminating with an annular lip 17 with a sharp outer edge, having the function of the so called "drip lip". The frusto-conical portion 14c of the cap support element 14 is joined by means of radial fins 18 to a cylindrical tubular element 19 surrounding the free end of the stem 11 of the valve shutter 10 so as to constitute a guide for the movement of the valve shutter. A transverse disc 20, formed integrally with the cylindrical tubular element 19 is disposed, with respect to the annular lip 17, in such a way as to delimit an annular mouth 21 from which liquid passes when the contents of the bottle are poured out.

Each of the radial fins 18 has a lower free edge 18a the spacing of which from the transverse plane containing the annular flange 6 of the valve body 2 is less than that between this transverse plane and a transverse plane which is tangential to the vertices of the plurality of teeth 16 formed on the upper edge of the cylindrical portion 15 of the valve body 2. Because of this each of the radial fins 18 engages into one of the spaces between two adjacent teeth 16 and thereby prevents the possibility of relative rotation between the valve body 2 and the cap support 14.

The annular flange 6 of the valve body 2 and the annular flange 14a of the cap support 14 are together fixed to the neck 3 of the bottle by means of band 22, preferably of metal, the upper edge 22a of which is turned inwardly and superimposed over a ring 23a situated at the bottom of the skirt of a cap 23 screwed on the threaded cylindrical portion 14b of the cap support 14. The ring 22a, which surrounds the free edge of the skirt of the cap 23, is connected to this part by means of small thin bridges which break upon first opening of the closure device. The cap 23 is also provided with a central internal pin 24 having a cruciform cross section (see FIG. 3) formed by two pairs of diametrically opposed longitudinal ribs 25. The pin 24, the cross section of which reduces progressively towards its free end, enters into the axial cavity 13 of the valve stem 11 when the cap 23 is screwed onto the cap support 14.

The radially outer edges of the opposed longitudinal ribs 25 of the pin 24 have sharp angles 26 the distance of which from the longitudinal axis of the cap 23 is less than the radius of the initial part at the mouth of the axial cavity 13 and, at the same time, is slightly greater than the radius of the inner end part of the axial cavity 13, that is the part nearest the head 12 of the valve shutter 10.

The stem 11 of the valve shutter 10 is made of a material, such as polythene, having a hardness lower than that of the material of which the pin 24 is made.

Figure 3:
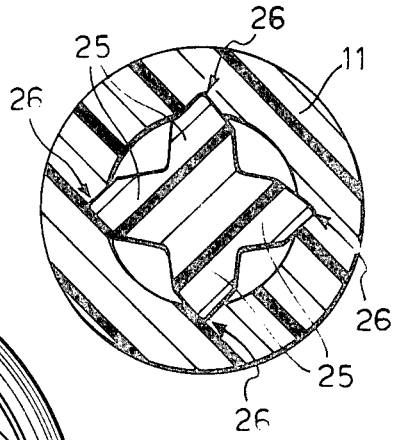
FIG. 3 is a section taken on the line III—III of FIG. 1.
Figure 4:
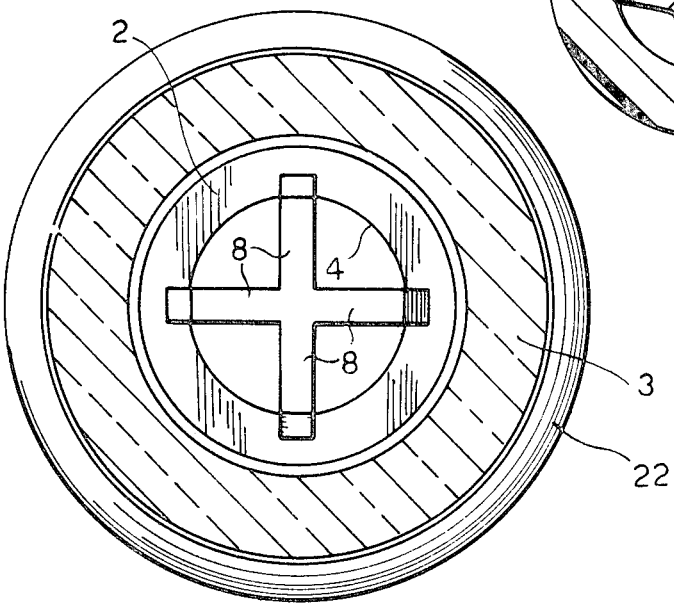
FIG. 4 is a section taken on the line IV—IV of FIG. 1.

The operation of the device described above is as follows:

The valve body of the closure device is first fitted to the neck of a bottle after the bottle has been filled and the head 12 of the valve shutter 10 is placed against the valve seat 5 constituted by the circular upper edge of the hole 4. The central pin 24 of the cap 23 is then introduced through the central hole of the disc 20, into the axial cavity 13 of the stem 11 of the valve shutter 10. As the cap 23 is screwed down onto the threaded cylindrical portion 14b of the cap support element 14 the sharp edges 26 of the ribs 25 bite into the inner face of the axial cavity 13 of the hollow valve stem 11 and cause deformation of the material of the stem 11 as shown in FIG. 3.

The effect of this is to create a firm engagement between the pin 24 of the cap 23 and the stem 11 of the shutter 10, which resists rotation or axial separation of the pin and the valve shutter. The head 12 of the valve shutter 10 is thus pressed against the associated valve seat 5. Leakage of the liquid contained in the bottle through the hole 4 is thus securely prevented. Following this, band 22 is applied and this fixes the closure device firmly to the neck 3 of the bottle. Now the cap 23 cannot be unscrewed without causing the breakage of the small bridges which join the ring 22a to the skirt of the cap itself. The presence of the band 22 therefore prevents the extraction of the contents of the bottle without visible damage to the closure device.

Upon first opening of the bottle, unscrewing of the cap 23 causes a rotation and a raising of the head 12 of the shutter 10 with respect to the annular seat of the valve 5 because of the frictional engagement or interference between the pin 24 and the material of the stem 11. This frictional or interference engagement is sufficient to overcome any resistance which may be caused by a decrease of pressure within the interior of the bottle, for example due to chilling thereof in a refrigerator.

What is claimed is:

1. In a bottle closure device, for sealably closing and preventing fraudulent filling of bottles fitted therewith, comprising:

a valve body adapted to be inserted as a plug into the neck of a bottle;

an annular flange at one end of said valve body, adapted to abut against the end face of the neck of said bottle;

means defining an annular valve seat within said valve body;

an inverted mushroom headed valve shutter located within said valve body, said valve shutter having:

(i) a hollow tubular stem the axial cavity of which is open at the free end thereof, and (ii) an enlarged head for cooperation with said valve seat;

a cap support fixed at one end to said valve body; and a cap, an externally threaded cylindrical portion of said cap support adapted for receiving a correspondingly threaded part of said cap, said cap having an axially extending central pin provided with longitudinal ribs, which pin engages into said axial cavity of said stem of said valve shutter when said cap is screwed onto said cap support, the improvement wherein, (a) said longitudinal ribs each have a sharp outer edge, (b) said axial cavity in said stem of said valve shutter has, an inner part adjacent said mushroom head of said valve shutter having a circular cross section, and (c) the size of said ribs on said pin of said cap being such that, when said cap is completely screwed onto said cap support, the radius of the circular section of said inner part of the axial cavity, at any point along the axis of said inner part, is less than the radial distance between said sharp outer edges and the axis of said pin of said cap at that point.

2. The closure device of claim 1, wherein the cross section of said pin reduces progressively towards the free end thereof.

3. The closure device of claim 1, wherein said axial cavity in said stem of said valve shutter has an initial mouth part adjacent the free end of said stem, said initial mouth part having a circular cross section the radius of which is greater than the radial distance between said sharp outer edges of said longitudinal ribs of said pin and the axis of said pin at the point along said axis of said pin in register with said initial mouth part of said axial cavity when said cap is fully screwed on to said cap support.

4. The closure device of claim 1, wherein said cap support has a tubular cylindrical part located coaxially within said cap support for guiding the axial movement of said valve stem of said valve shutter, and a plurality of radial fins extending from said cap support to said cylindrical tubular element whereby to support said tubular element on said cap support, and a cylindrical portion of said valve body, adjacent said annular flange thereof, on a side facing towards said cap support, said cylindrical portion being inserted into said cap support and having a free edge with a plurality of teeth; the transverse plane containing the lower free edges of said radial fins being situated a smaller distance from the plane containing said annular flange than the transverse plane which is tangential to the vertices of said teeth, whereby said teeth co-operate with said radial fins to act as a stop to prevent possible relative rotation between said cap support and said valve body.

5. The closure device of any one of claims 1, 2, 3 or 5, wherein there are a plurality of circumferential concentric sealing lips on that face of said annular flange of said valve body which abuts the end face of the neck of the bottle in use of the device, said plurality of circumferential concentric sealing lips extending in a direction generally transverse the plane of said flange, and the radially outermost said sealing lip having a greater height than the other said sealing lips whereby it engages against the outer face of the neck of the bottle adjacent to the end face thereof when said closure device is fitted to the neck of a bottle.

* * * * *